US006815896B2

(12) United States Patent
Kang

(10) Patent No.: US 6,815,896 B2
(45) Date of Patent: Nov. 9, 2004

(54) BULB WITH REFLECTOR AND ELECTRODELESS DISCHARGE LAMP USING SAME

(75) Inventor: Hyung-Joo Kang, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 93 days.

(21) Appl. No.: 10/143,767

(22) Filed: May 14, 2002

(65) Prior Publication Data

US 2003/0057841 A1 Mar. 27, 2003

(30) Foreign Application Priority Data

Sep. 27, 2001 (KR) ..... 2001-60191

(51) Int. Cl.[7] ..... H01J 7/46
(52) U.S. Cl. ..... 315/39; 315/248
(58) Field of Search ..... 315/248, 39; 313/484, 313/493

(56) References Cited

U.S. PATENT DOCUMENTS 4,498,029 A * 2/1985 Yoshizawa et al. ..... 315/39

* cited by examiner

*Primary Examiner*—David Vu
(74) *Attorney, Agent, or Firm*—Fleshner & Kim, LLP

(57) ABSTRACT

An electrodeless discharge lamp, including a waveguide for transmitting microwave emitted from a magnetron, a resonator positioned at an outlet port of the waveguide, for blocking the microwave and passing light and a united bulb, which is positioned inside the resonator, including a bulb portion which seals inert gas, and emits light by the microwave, and a reflective portion for reflecting the light emitted from the bulb portion forwards, which are integrally formed, can reduce assembly time of a lamp and reduce the whole size of a lamp.

21 Claims, 5 Drawing Sheets

BULB WITH REFLECTOR AND ELECTRODELESS DISCHARGE LAMP USING SAME

BACKGROUND OF THE INVENTION

1. Field of the Invention

The present invention relates to an electrodeless discharge lamp and particularly, to a bulb with a reflector and an electrodeless discharge lamp using the same, capable of emitting light in a bulb where inert gas is sealed using microwave.

2. Description of the Background Art

An electrodeless discharge lamp is a kind of a lamp including a bulb in which appropriate amount of inert gases, such as Argon and the like are sealed so that light is emitted under the plasma condition by exciting with microwave. Such electrodeless discharge lamp has longer life span than that of an incandescent lamp or fluorescent lamp which is generally used and has higher lighting effect.

FIG. 1 is a longitudinal sectional view showing a conventional electrodeless discharge lamp. As shown in the drawing, the conventional electrodeless discharge lamp includes a case 1, a magnetron 3 positioned inside the case 1, for outputting microwave, a waveguide 5 installed in the case 1, for transmitting the microwave outputted from the magnetron 3, a bulb 7 positioned and protruded outwards from the front side of the case 1, in which inert gas G is sealed, for emitting light, a resonator 19 fixed at the outlet port of the waveguide 5, formed in a mesh structure, to block microwave and pass light, and a reflector 11 fixed on the front side of the case around the resonator 19, for reflecting light emitted from the bulb 7 to the front thereof.

At the inner side of the case 1, a high voltage generator 13 is positioned to supply a power with a high voltage.

In the waveguide 5, a shaft hole 5*a* is formed at the center portion and a rotational shaft 10 which can rotate the bulb 7 passes into the shaft hole 5*a*. A bulb motor 9 combined with the rotational shaft 10 is installed at the bottom of the waveguide 5 to cool the bulb 7 by rotating the bulb.

On the other hand, a cooling unit 14 is installed in the rear portion of the case 1 to cool the magnetron 3 and the high voltage generator 13. The cooling unit 14 includes a fan housing 17 which is a passage through which outside air flows into the case, a cooling fan 15 positioned in the fan housing 17 and a fan motor 16 for driving and rotating the cooling fan.

On the other hand, an inner side surface of the reflector 11 is formed as a reflective face to reflect light emitted from the bulb 7 forwards and a reflecting mirror 12 is installed to reflect light emitted from the bulb 7 to the side of waveguide 5 at the outlet of the waveguide 5.

However, the conventional electrodeless discharge lamp has problems that much time is taken to manufacture and assemble the lamp and the whole size becomes larger since the conventional electrodeless discharge lamp is assembled by respectively manufacturing the reflector 11, reflecting mirror 12, bulb 7 and resonator 19.

Due to the above problems, the conventional electrodeless discharge lamp can not be applied to low power systems, namely, to a liquid crystal projector, projection television and the like as a power source, which require a compact composition as a light source, since the size of the lamp is increased by the size of the reflector 11 and assembly structure, even though it has longer life span than that of the incandescent lamp or fluorescent lamp which is generally used and has higher lighting effect.

SUMMARY OF THE INVENTION

To solve the above problem of the conventional art, the present invention provides a bulb with a reflector and an electrodeless discharge lamp using the same capable of reducing assembly time of the bulb and reflector and the size of the lamp by forming the bulb where inert gas is sealed and reflector for integrally reflecting light.

To achieve these and other advantages and in accordance with the purpose of the present invention, as embodied and broadly described herein, there is provided an electrodeless discharge lamp in accordance with the present invention, including a waveguide for transmitting a microwave generated in a magnetron, a resonator installed at an outlet port of the waveguide, for blocking the microwave and passing light and a united bulb, formed with a bulb portion sealing inert gas, for emitting light by the microwave and a reflective portion for integrally reflecting light emitted from the bulb portion forwards, which is positioned inside the resonator.

At least a part of the resonator is formed in a mesh structure so that the light emitted from the united bulb is emitted to the outside.

The resonator includes a non-mesh portion, formed in a cylindrical structure with both sides opened, which is fixed to the outlet of the waveguide and a mesh portion installed at an opened portion of a side of the non-mesh portion, for passing light emitted from the united bulb.

The united bulb is connected with a bulb motor, which is fixed with the resonator, by a rotational shaft and is cooled by rotating.

An injection hole of the united bulb is formed on a side and a packing member seals the injection hole.

The waveguide is assembled in a case and the outlet port is protruded out of the case.

The magnetron is fixed on the side surface of the waveguide in the case.

A high voltage generator for supplying a raised high voltage to the magnetron is installed in the case.

A cooling unit is positioned at one side of the case to cool the magnetron and high voltage generator.

The bulb with a reflector for an electrodeless discharge lamp in accordance with the present invention to achieve the above object, includes a bulb portion in which inert gas is sealed and a reflective portion extended integrally from a side of the bulb portion and a reflective face in at least one part to reflect the light emitted from the bulb portion.

The united bulb and reflective portion are formed with a material that the microwave can penetrate and an injection hole is formed on a side of the united bulb and a packing member seals the injection hole.

In accordance with an embodiment of the present invention, a cross-section of the reflective portion is formed in a parabolic structure and the bulb portion is formed to be positioned at the focus of the reflective face.

The bulb portion is formed in the globular shape and integrally connected to the reflective portion by the connection portion.

In accordance with another embodiment of the present invention, a side surface of the reflective portion is formed in a semicircular structure and the bulb portion is formed in the globular shape and integrally connected to the inner central surface of the reflective portion.

In accordance with still another embodiment of the present invention, the reflective portion is formed in a flat surface structure and the bulb portion is formed in the globular shape, positioned a certain distance apart from the reflective portion and integrally connected to the reflective portion by the connection portion.

The foregoing and other, features, aspects and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
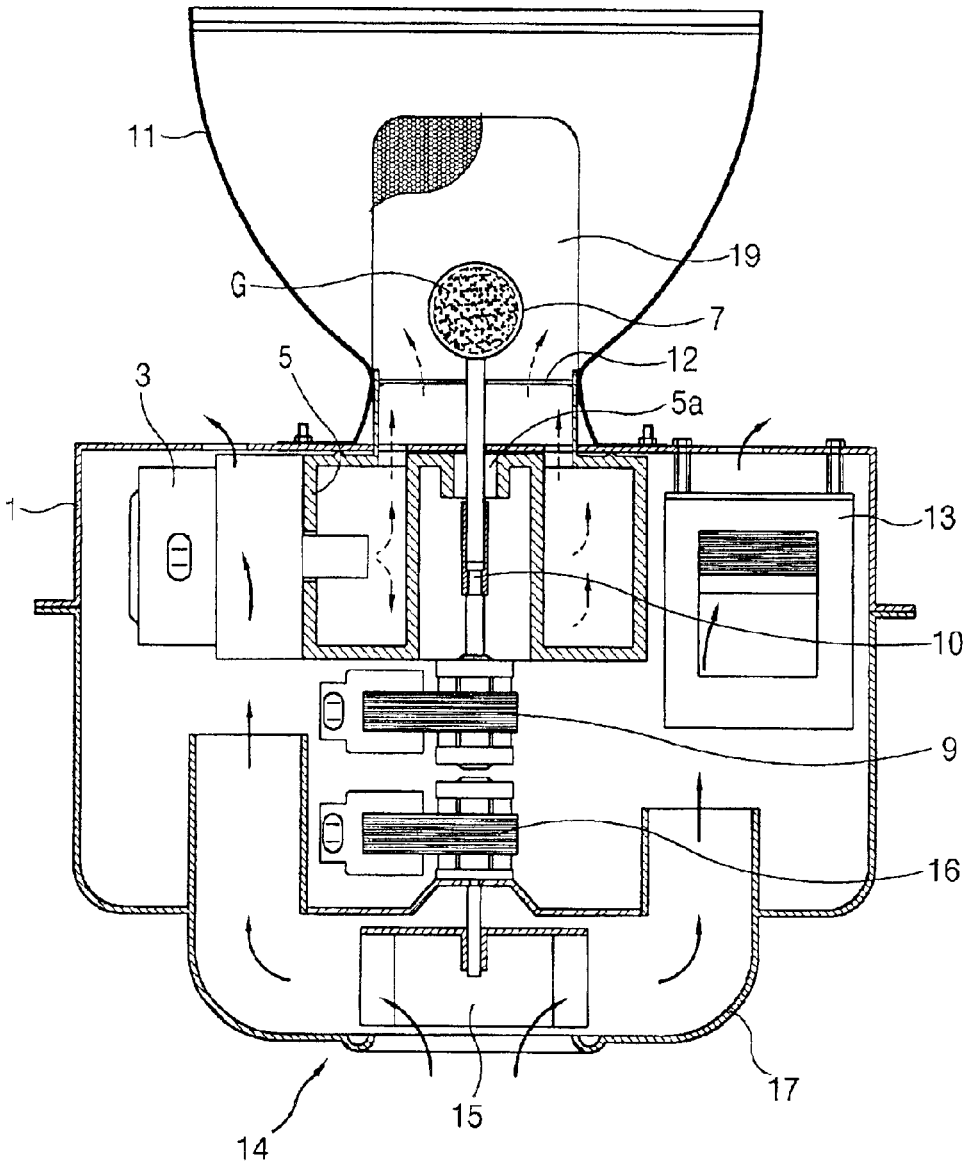
FIG.1 CONVENTIONAL ART
FIG. 1 is a longitudinal sectional view showing a conventional electrodeless discharge lamp.
Figure 2:
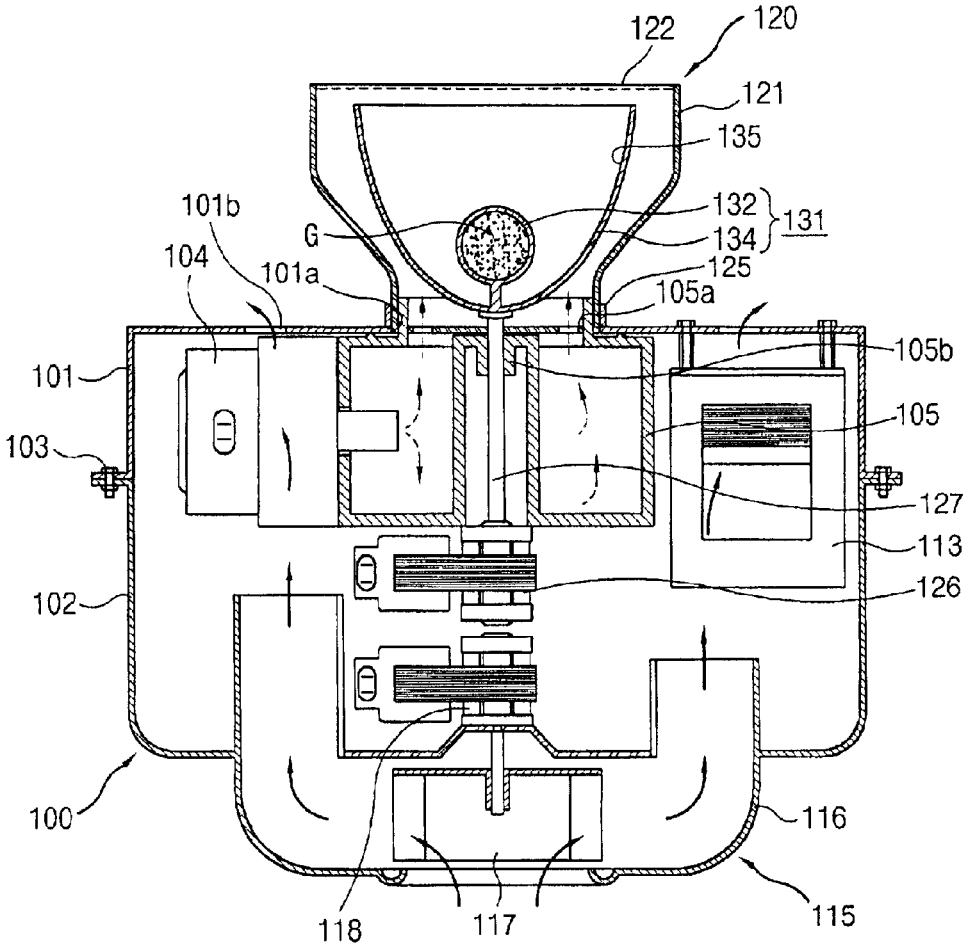
FIG. 2 is a longitudinal sectional view showing an electrodeless discharge lamp in accordance with a first embodiment of the present invention.

FIG. 2 is a longitudinal sectional view showing an electrodeless discharge lamp in accordance with a first embodiment of the present invention.

As shown in FIG. 2, the electrodeless discharge lamp in accordance with the first embodiment of the present invention includes a case 100 including an opening portion 101*a* formed at a side thereof, a waveguide 105, fixed in the case 100, for transmitting microwave generated in a magnetron 104, a resonator 120 fixed to an outlet port 105*a* of the waveguide 105, for blocking the microwave and passing light and a united bulb 131, which is installed at the inner side of the resonator 120 and seals inert gas, for simultaneously emitting light by the microwave and reflecting light emitted from the bulb portion forwards.

Also, in the case 100, a high voltage generator 113 for applying a high voltage into the magnetron 104 is installed and a cooling unit 115 for cooling the magnetron 104 and high voltage generator 113, is positioned in the rear portion of the case 100.

A bulb motor 126 is installed at the lower side of the waveguide 105 to cool the united bulb 131 by rotating the united bulb 131.

The main components of the present invention with above composition will be described in detail.

First, the case 100 is formed by respectively assembling a front case 101 and rear case 102 with a bolt 103.

In the front case 101, the opening portion 101*a* is positioned on the front surface so that the outlet 105*a* of the waveguide 105 is exposed to the outside of the case 100 and an exhaust hole 101*b* for discharging internal air to the outside is positioned. In the rear case 102, a fan housing 116 for forming the cooling unit 115 is formed.

Then, the waveguide 105 is formed in a cylindrical structure to transmit microwave and on the side surface of the waveguide 105, a magnetron 104 is installed so that the microwave outputted from the magnetron 104 is transmitted to the inside of the resonator 120.

At the center of the waveguide 105, a shaft hole 105*b* is formed and accordingly, a rotational shaft 127 connected between the bulb motor 126 and the united bulb 131 passes the shaft hole 105*b*.

At least a part of the resonator 120 is formed in a mesh structure so that the light emitted from the united bulb 131 is emitted to the outside.

The resonator 120 includes a non-mesh portion 121, formed in a cylindrical structure with both sides opened, which is fixed to the outlet 105*a* of the waveguide 105 and a mesh portion 122 installed at an opened portion of a side of the non-mesh portion 121, for passing light emitted from the united bulb 131 therethrough.

In the resonator 120, the opening portion of other side of the non-mesh portion 121 is tightened by a fixing band 125 to the outlet 105*a* of the waveguide 105.

Then, the cooling unit 115 includes the fan housing 116 positioned in the rear case 102, a cooling fan 117 positioned in the fan housing 116, for compulsorily flowing the external air to the inside of the case 100 and a fan motor 118 for driving and rotating the cooling fan 117.

Figure 3:
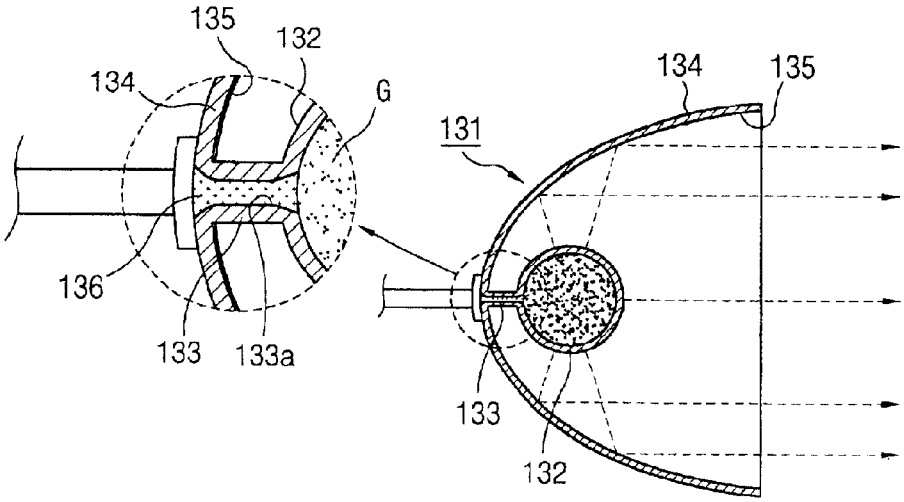
FIG. 3 is a longitudinal sectional view showing the electrodeless discharge lamp in accordance with the first embodiment of the present invention.

On the other hand, FIG. 3 is a longitudinal sectional view showing the united bulb in detail.

The united bulb 131 includes a bulb portion 132 in which inert gas is sealed, a reflective portion 134 extended integrally from the rear side of the bulb portion 132 and a reflective face 135 to reflect the light emitted from the bulb portion 132 forwards and a connecting portion 133 formed in a segment structure for integrally connecting the bulb portion 132 and reflective portion 134.

Here, the united bulb 131 is formed with a material that the microwave can penetrate.

A cross-section of the reflective portion 134 is formed in a parabolic structure and the bulb portion 132 is positioned at the focus of the reflective face 135 of the reflective portion 134.

An injection hole 133*a* is formed in the connecting portion 133 to injecting inert gas into the bulb portion 132 and a packing member 136 is filled in the gas injection hole 133*a* to seal the bulb portion 132.

The united bulb 131 is cooled by rotating to reduce the degree that the bulb is partially heated in emitting light with the microwave and accordingly, the rotational shaft 127 connected to the bulb motor 126 is combined to the injection hole 133*a* positioned in the rear portion of the reflective portion 134.

At this time, the rotational shaft 127 can be fixed by combining the shaft to the injection hole 133*a* being pressed or attaching the shaft to the reflective portion 134.

On the other hand, the method for manufacturing such united bulb will be described with reference to FIG. 4.

Figure 4:
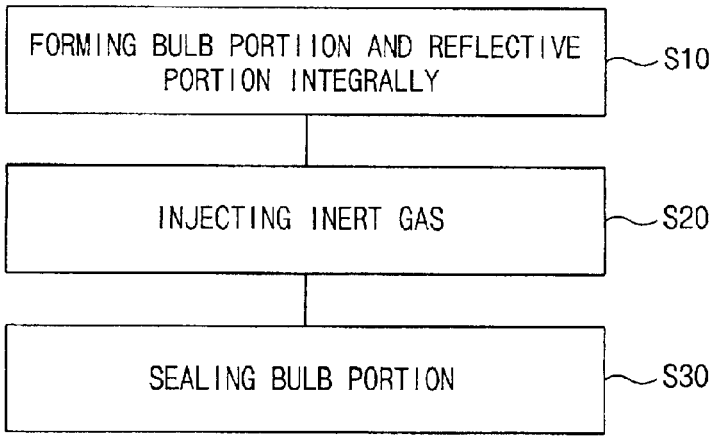
FIG. 4 is a flow chart showing a method for manufacturing a united bulb for an electrodeless discharge lamp in accordance with the first embodiment of the present invention.

FIG. 4 is a flow chart showing the method for manufacturing the united bulb for an electrodeless discharge lamp in accordance with the first embodiment of the present invention.

First, the bulb portion 132, connecting portion 133 and the reflective portion 134 are integrally formed (S10). Then, inert gas is injected to the inside of the bulb portion 132 through the injection hole 133*a* of the connecting portion 133 (S20). Later, the united bulb 131 is completed by sealing (S30) the injection hole 133*a* with a packing member 136.

The assembly and operation of the electrodeless discharge lamp in accordance with the first embodiment of the present invention, composed and manufactured as above, will be described as follows.

The waveguide 105, magnetron 104, high voltage generator 113 and cooling unit 115 are assembled in the case 100. At this time, the bulb motor 126 is installed in the waveguide 105 so that the rotational shaft 127 is protruded to the outside of the outlet 105*a* of the waveguide 105.

Then, the united bulb 131 is assembled being combined to the rotational shaft 127 and the assembly is positioned at the outer side of the united bulb 131 being covered with the resonator 120. Then, the assembly of the electrodeless discharge lamp is completed by fixing the resonator 120 to the outlet 105*a* of the waveguide 105 using the fixing band 125.

Such electrodeless discharge lamp of the present invention can be easily assembled since it is necessary to install just the resonator 120 under the condition that the united bulb 131 is assembled outside the case 100.

In the electrodeless discharge lamp, light is emitted by exciting the inert gas inside the bulb portion 132 as the microwave outputted from the magnetron 104 is transmitted to the inside of the resonator 120 through the waveguide 105.

Therefore, part of the light emitted in the bulb portion 132 is emitted to the front thereof, directly passing through the mesh portion 122 of the resonator 120 and the rest part of light is reflected to the reflective face 135 and then reflected to the front thereof, passing through the mesh portion 122.

Figure 5:
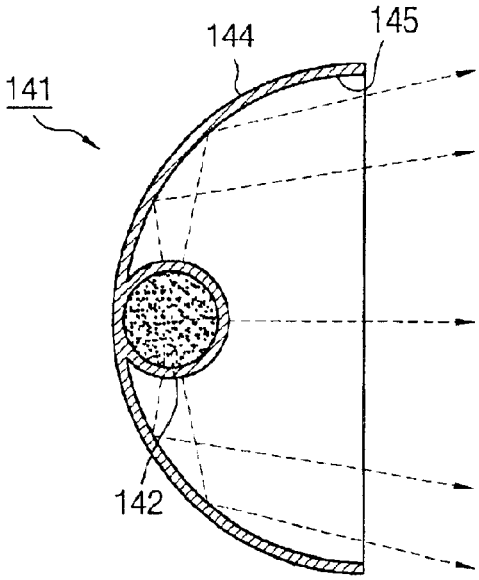
FIGS. 5 and 6 are longitudinal sectional views showing the bulb, with the reflector for the electrodeless discharge lamp in accordance with the second and third embodiments of the present invention respectively.
Figure 6:
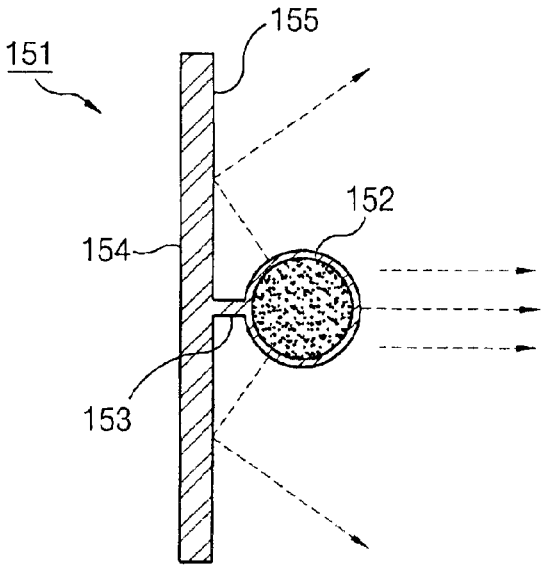

FIGS. 5 and 6 are longitudinal sectional views showing the bulb with the reflector for the electrodeless discharge lamp in accordance with the second and third embodiments of the present invention respectively.

In the united bulb 141 shown in FIG. 5, a reflective portion 144 is formed in a semicircular shape and a reflective face 145 is formed on the inner surface of the reflective portion 144. The bulb portion 142 is formed in a globular shape and integrally connected onto the central inner surface of the reflective portion 144.

The united bulb 151 shown in FIG. 6 has the reflective portion 154 formed in a flat plate shape so that a reflective face 155 has a flat shape and the bulb portion 152 is formed in a globular shape and connected to the reflective portion 154, a certain distance apart from the reflective portion 154 by the connection portion 153 integrally.

Figure 7:
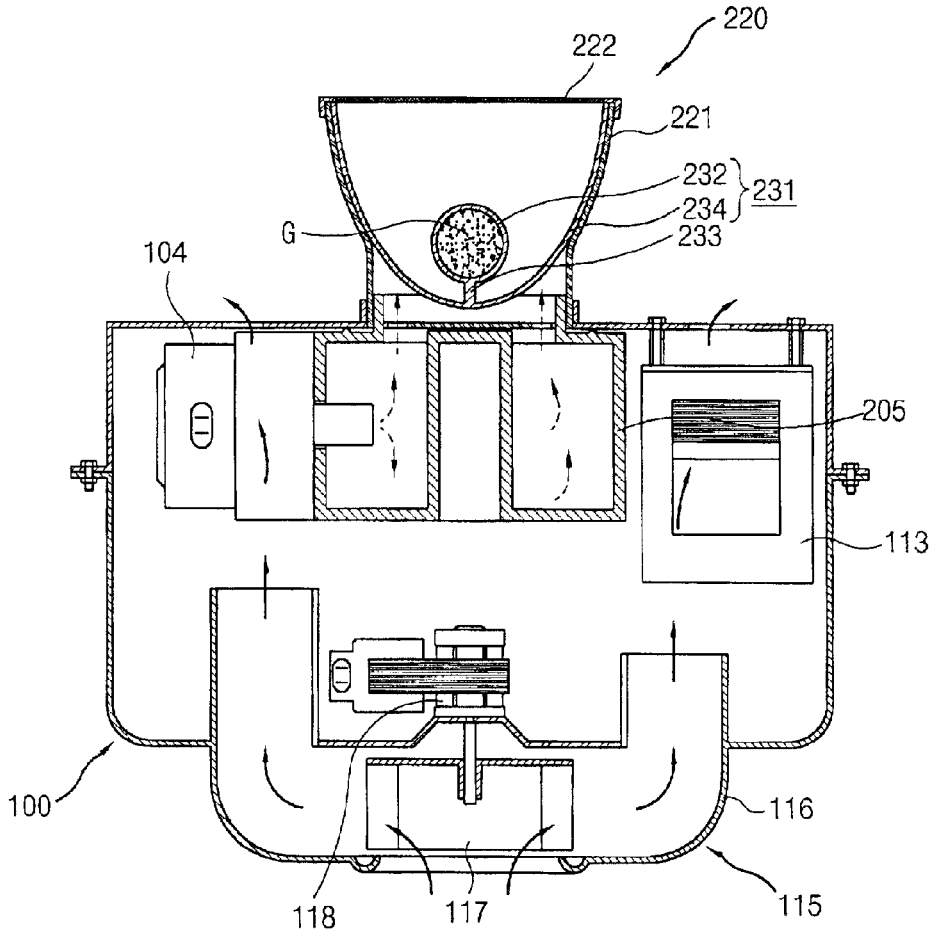
FIG. 7 is a longitudinal sectional view showing the electrodeless discharge lamp in accordance with the fourth embodiment of the present invention.

FIG. 7 is a longitudinal sectional view showing the electrodeless discharge lamp in accordance with the fourth embodiment of the present invention. Here, same portions as the composition of the first embodiment above described will be designated as the same reference numerals and description in detail will be omitted.

In the fourth embodiment of the present invention, the united bulb 231 is not supported by the bulb motor and rotational shaft and supported by the resonator 220, differently from the case in the first embodiment.

Namely, in the electrodeless discharge lamp in accordance with the fourth embodiment of the present invention, the united bulb 231 includes a bulb portion 232, a reflective portion 234 for reflecting the light emitted from the bulb portion 232 forwardly and a connecting portion 233 formed in a segment structure to integrally connect the bulb portion 232 and the reflective portion 234.

The united bulb 231 is formed in a structure that the bulb shaft as in the first embodiment, is not connected. Therefore, a waveguide 205 does not need to form a hole through which the bulb shaft passes.

The resonator 120 includes the non-mesh portion, formed in a cylindrical structure with both sides opened and the mesh portion 222 fixed being covered at the front side of the non-mesh portion 221 to prevent the united bulb from being seceded to the outside thereof and to pass the light emitted from the united bulb 231 therethrough.

Therefore, the united bulb 231 is positioned, being supported at the inner side of the non-mesh portion 221 and the mesh portion 222 of the resonator 120.

As described above, the electrodeless discharge lamp in accordance with the present invention can reduce assembly time of the lamp and reduce the whole size of the lamp by integrally forming the bulb and the reflector and installing the resonator at the outside thereof, thus to be applicable to a low power system.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless discharge lamp, comprising:

a waveguide for transmitting a microwave emitted from a magnetron;

a resonator positioned at an outlet port of the waveguide, for blocking the microwave and passing light; and a united bulb, which is positioned inside the resonator, including a bulb portion which seals inert gas and emits light by the microwave, and a reflective portion for reflecting the light emitted from the bulb portion forwards, which are integrally formed.

2. The lamp of claim 1, wherein at least a part of the resonator is formed in a mesh structure so that the light emitted from the united bulb is emitted to the outside.

3. The lamp of claim 1, wherein the resonator comprises a non-mesh portion, formed in a cylindrical structure with both sides opened, which is fixed to the outlet port of the waveguide and a mesh portion coupled at an opened portion of the non-mesh portion, for passing light emitted from the united bulb.

4. The lamp of claim 1, wherein the united bulb, connected, with a bulb motor fixed to the resonator by a rotational shaft, is cooled by rotating.

5. The lamp of claim 1, wherein an injection hole is formed on a side of the united bulb and a packing member seals the injection hole.

6. The lamp of claim 1, wherein a cross-section of the reflective portion is formed in a parabolic structure.

7. The lamp of claim 1, wherein the waveguide is assembled in a case and the outlet port is protruded out of the case.

8. The lamp of claim 7, wherein the magnetron is fixed on the side surface of the waveguide in the case.

9. The lamp of claim 7, wherein a high voltage generator for supplying a raised high voltage to the magnetron is installed in the case.

10. The lamp of claim 1, wherein a position of the united bulb is supported by the resonator.

11. A bulb with a reflector for an electrodeless discharge lamp, comprising:

a bulb portion in which inert gas is sealed, wherein an injection hole is formed on a side of the bulb portion and a packing member seals the injection hole; and a reflective portion integrally extended from a side of the bulb portion and having a reflective face in at least one part to reflect the light emitted from the bulb portion.

12. The bulb of claim 11, wherein the bulb portion, the reflective portion, or both are formed with a material penetrable by microwave energy.

13. The bulb of claim 11, wherein a cross-section of the reflective portion is formed in a parabolic structure.

14. The bulb of claim 13, wherein the bulb portion is formed to be positioned at the focus of the reflective face.

15. The bulb of claim 14, wherein the bulb portion is formed in the globular shape and integrally connected to the reflective portion by a connection portion.

16. The bulb of claim 11, wherein a cross-section of the reflective portion is formed in a semicircular structure.

17. The bulb of claim 16, wherein the bulb portion is formed in the globular shape and integrally connected to the inner central surface of the reflective portion.

18. The bulb of claim 11, wherein the reflective portion is formed in a flat surface structure.

19. The bulb of claim 18, wherein the bulb portion is formed in a globular shape, positioned a certain distance apart from the reflective portion and integrally connected to the reflective portion by a connection portion.

20. The bulb of claim 11, wherein said bulb portion and said reflective portion are formed as a single, continuous piece.

21. A bulb with a reflector for an electrodeless discharge lamp, comprising:

a bulb portion in which inert gas is sealed; and a reflective portion integrally extended from a side of the bulb portion and having a reflective face in at least on part to reflect the light emitted from the bulb portion, wherein an injection hole is formed on a side of the bulb portion and a packing member seals the injection hole.

* * * * *